US006021871A

United States Patent [19]

Grabner

[11] Patent Number: 6,021,871

[45] Date of Patent: Feb. 8, 2000

[54] APPARATUS FOR OPENING AND CLOSING A CAR DOOR AND A SHAFT DOOR OF AN ELEVATOR INSTALLATION

[75] Inventor: Bodo Grabner, Inwil, Switzerland

[73] Assignee: Inventio AG, Hergiswil, Switzerland

[21] Appl. No.: 08/960,001

[22] Filed: Oct. 29, 1997

[30] Foreign Application Priority Data

Oct. 29, 1996 [EP] European Pat. Off. ..... 96810721

[51] Int. Cl.[7] ..... B66B 13/06

[52] U.S. Cl. ..... 187/335; 49/116

[58] Field of Search ..... 187/335, 330, 187/319; 49/116, 120

[56] References Cited

U.S. PATENT DOCUMENTS 5,005,673 4/1991 Rivera ..... 187/52 LC
5,819,877 10/1998 Rivera et al. ..... 187/335

FOREIGN PATENT DOCUMENTS 0 164581 10/1985 European Pat. Off. .
0164581 12/1985 European Pat. Off. .
0513509 11/1992 European Pat. Off. .
0709334 5/1996 European Pat. Off. .
2625991 7/1989 France .

*Primary Examiner*—Kenneth W. Noland
*Attorney, Agent, or Firm*—MacMillan, Sobanski & Todd, LLC

[57] ABSTRACT

An apparatus for opening and closing a car door and a shaft door of an elevator installation includes an entraining system (E) arranged at the car door and a cooperating locking mechanism (L). The entraining system (E) has a pair of spreadable entraining cams (1, 2) connected to first and second levers (3.1, 3.2) forming a parallelogram. A stationary guide rail (4.1) on the car has an entry cam (4) which receives a roller (5) on the entraining cam (1) to spread the parallelogram against a tension spring (6) and into engagement with first and second shaft lock rollers (7*a*, 7*b*) on the floor door to couple the doors together. The locking mechanism (L) has a transmission lever (8) attached to one entraining cam (2) and pivotally connected to a locking rocker (9) carrying a support roller (10). The locking rocker (9) also is pivotally connected with a catch (11) having a lug (11.2) that detents with a stationary lock plate (13) on the car to prevent opening of the car door. As the car door opens, the support roller (10) engages the support rail (12) on the floor door to pivot the catch (11) and release the lug (11.2) from the stationary lock plate (13) to unlock the car door.

7 Claims, 3 Drawing Sheets

APPARATUS FOR OPENING AND CLOSING A CAR DOOR AND A SHAFT DOOR OF AN ELEVATOR INSTALLATION

BACKGROUND OF THE INVENTION

The present invention relates generally to an apparatus for opening and closing a car door and a shaft door of an elevator installation, wherein in the case of a stop of an elevator car at a floor, an entraining system couples the car door and the shaft door and a locking device unlocks the doors in the opening process and locks them in the closing process.

Equipment for driving, coupling and locking a car door and a shaft door for elevators is shown in the European patent specification 0 513 509. Upon arriving at a destination floor, a door drive device is switched to an opening mode. Before the sliding door executes a movement, a strip-shaped drive means draws a clamping element along a sliding guide, whereby a control cam, which actuates a pull rod by means of a double lever, is rotated. In that case the pull rod spreads an entraining parallelogram which projects at coupling rollers of the shaft door. The double lever in turn presses up an actuating roller of a car door lock, whereby the car door lock is taken out of the locking position. Then the doors can be opened.

This known equipment has a complicated mechanical construction and consists of individual parts which are expensive to produce, such as a clamping element, a sliding guide, a control cam, rotational axles, a toggle lever, rollers, a double lever, a pull rod, a support roller, a car door lock, an actuating strap, etc., which in matters of cost, manufacture, maintenance, susceptibility to fault and reliability is very disadvantageous. Moreover, it is to be regarded as a disadvantage that before the actual opening process can begin, the door drive must spread the entraining parallelogram and the locking mechanism must actuate the car door, by which a loss of time arises.

SUMMARY OF THE INVENTION

The present invention concerns an apparatus for opening and closing a car door and a shaft door of an elevator installation during a stop of an elevator car at a floor. The apparatus includes an entraining system coupling the elevator car door to an adjacent shaft door, the entraining system having first and second entraining cams connected by a pair of levers forming a spreadable parallelogram, and a locking mechanism having a transmission lever attached to the second entraining cam, a locking rocker pivotally attached to the transmission lever, a support roller mounted on the locking rocker, a catch pivotally attached to the locking rocker, a support rail attached to the shaft door and a lock plate attached to the car, whereby when the car door is closed the catch engages the lock plate to lock the car door and as the car door is opened, the support roller contacts the support rail rotating the catch out of engagement with the lock plate and unlocking the car door.

Here, it is an object of the present invention is to avoid the disadvantages of the known equipment and by providing a device by which the car door of an elevator car is unlocked in the opening process and locked in closing process.

The advantages achieved by the present invention are that the car door of the elevator car can be opened without delay upon movement of the elevator car into a floor and the elevator car can leave without delay after the closing process. It is further advantageous that the car door cannot be opened outside a predetermined unlocking zone and that within the determined unlocking zone the car door can be opened manually, even in the case of power loss, without further measures. Moreover, the device, which is built up from a minimum number of mechanical elements, is economic in manufacture, maintenance-free and independent of electrical and electronic components susceptible to fault.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
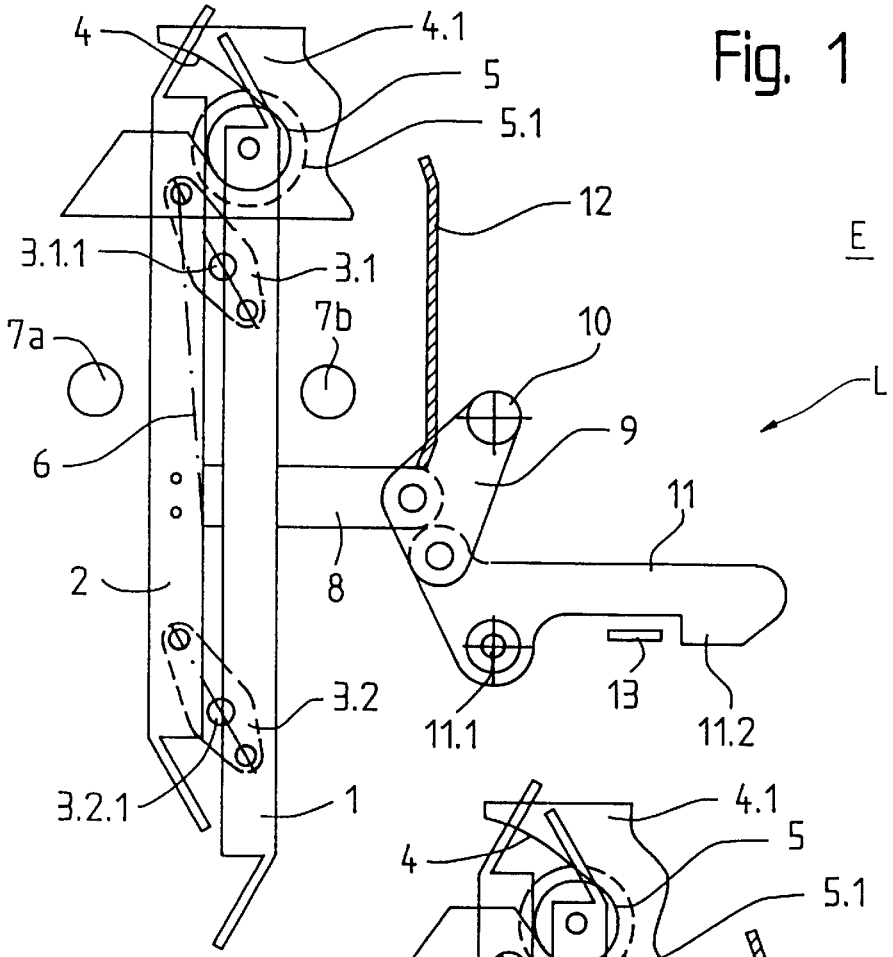
FIG. 1 is schematic view of the apparatus according to the present invention including an entraining system for coupling an elevator car door and shaft door, and a locking mechanism for unlocking of the doors in the opening process and locking the doors in the closing process.
Figure 2:
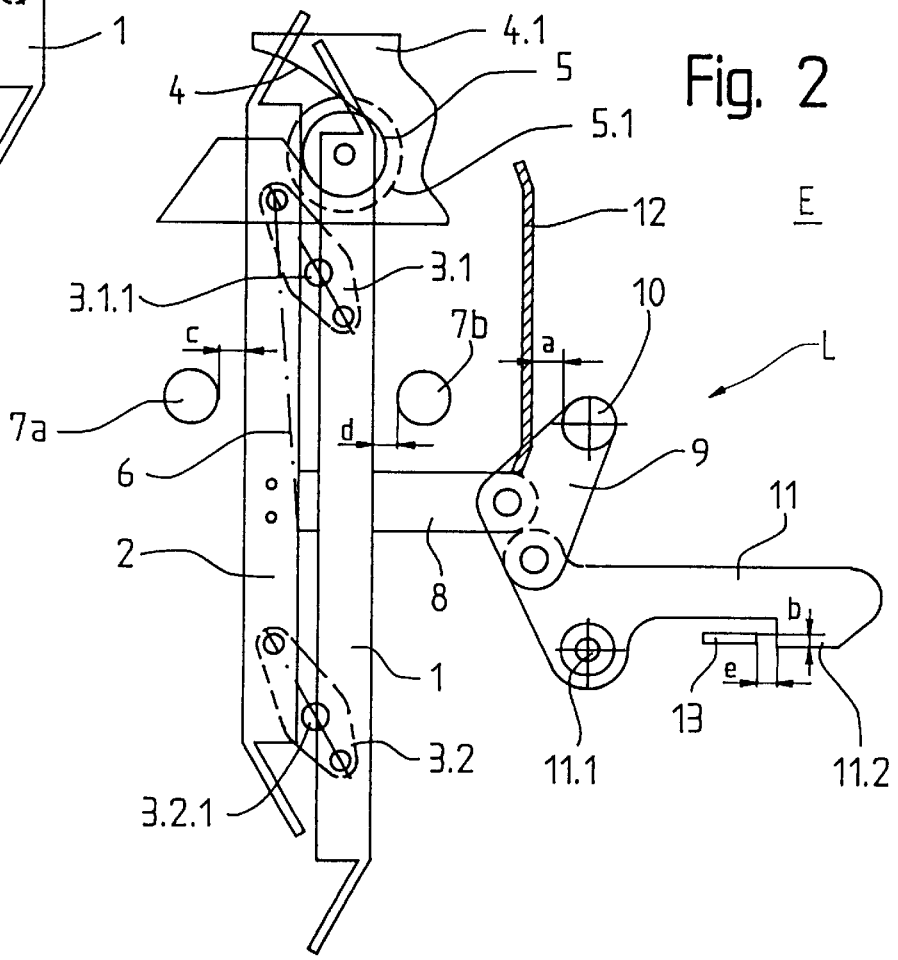
FIG. 2 shows apparatus of the FIG. 1 with the entraining system and locking mechanism positions before the opening process.

In the FIGS. 1 to 6, there is shown an entraining system E according to the present invention that comprises a first entraining cam 1 and a second entraining cam 2, extending generally vertically adjacent one another, and vertically spaced apart first and second levers 3.1, 3.2 pivotally connected between the cams. The entraining system E is arranged at a car door, which is not illustrated, and is, for example, horizontally displaceable. The system E also includes a stationary travel rail 4.1, which is arranged at the car construction, an entry cam 4, a roller 5 with rim flanges 5.1, a tension spring 6, and first and second shaft lock rollers 7*a*, 7*b* arranged at a floor door which is not illustrated and is, for example, horizontally displaceable. The levers 3.1, 3.2 are rotatably mounted at lever axles 3.1.1, 3.2.1 standing in connection with the car door and are pivotally connected at their ends with the entrainers 1, 2. The levers 3.1, 3.2 and the entrainers 1, 2 form a spreadable parallelogram, wherein when the entrainers are spread apart the shaft door is coupled with the car door by means of the shaft lock rollers 7*a*, 7*b*. The tension spring 6 engages at one end at the first lever 3.1 and at the other end at a fixed point, with which the car door stands in connection. The tension spring holds the levers 3.1, 3.2 and the entrainers 1, 2 in a self-locking manner in the spread setting by a small spring force.

In the opening process and the closing process the car door is moved by a door drive, which is not illustrated, wherein the roller 5 arranged at the upper end of the first entrainer 1 rolls along on the entry cam 4. The roller movement corresponding to the cam track is transmitted to the first entrainer 1 and, by means of the levers 3.1, 3.2, to the second entrainer 2. In that case, the entrainers 1, 2 move away from one another or towards one another. The rim flanges 5.1 serve for centering the roller 5 on the entry cam 4.

In the FIGS. 1 to 6, a locking mechanism L comprises a transmission lever 8, which is arranged at one end at the second entrainer 2 and is pivotally connected at the other end with a locking rocker 9. A support roller 10 is arranged at the locking rocker 9. Moreover, the locking rocker 9 is pivotally connected with a catch 11, which is rotatably mounted at a catch axle 11.1 arranged at the car door. The path of movement of the support roller 10 is limited by a rail, which is arranged at the floor door, designated subsequently as a support rail 12. A lug 11.2 of the catch 11 detents with a lock plate 13 stationarily arranged on the car.

The FIGS. 2 to 6 show the manner of function of the equipment according to the invention. The starting position before the opening process is illustrated in the FIG. 2. The elevator car is disposed in travel and/or in readiness for the door opening. The car door and the shaft door are closed and locked in the shown starting position of the locking mechanism L. The entrainers 1, 2 are spread and the roller 5 is disposed in the entry cam 4. The catch 11 is closed and has a prescribed overlap spacing "b" of at least seven millimeters relative to the lock plate 13. The support roller 10 is disposed in its starting position and has a spacing "a" relative to the support rail 12. The first entraining cam 1 has a spacing "d" relative to the shaft lock roller 7*b* and the second entraining cam 2 has a spacing "c" relative to the shaft lock roller 7*a*. The spacings "a", "c", and "d" are equal in the starting position shown in the FIG. 2 and characterize the lateral through-travel play, during floor through-travel of the elevator car, between the entraining system/locking mechanism and the stationary shaft lock rollers 7*a*, 7*b* and the support rail 12.

Figure 3:
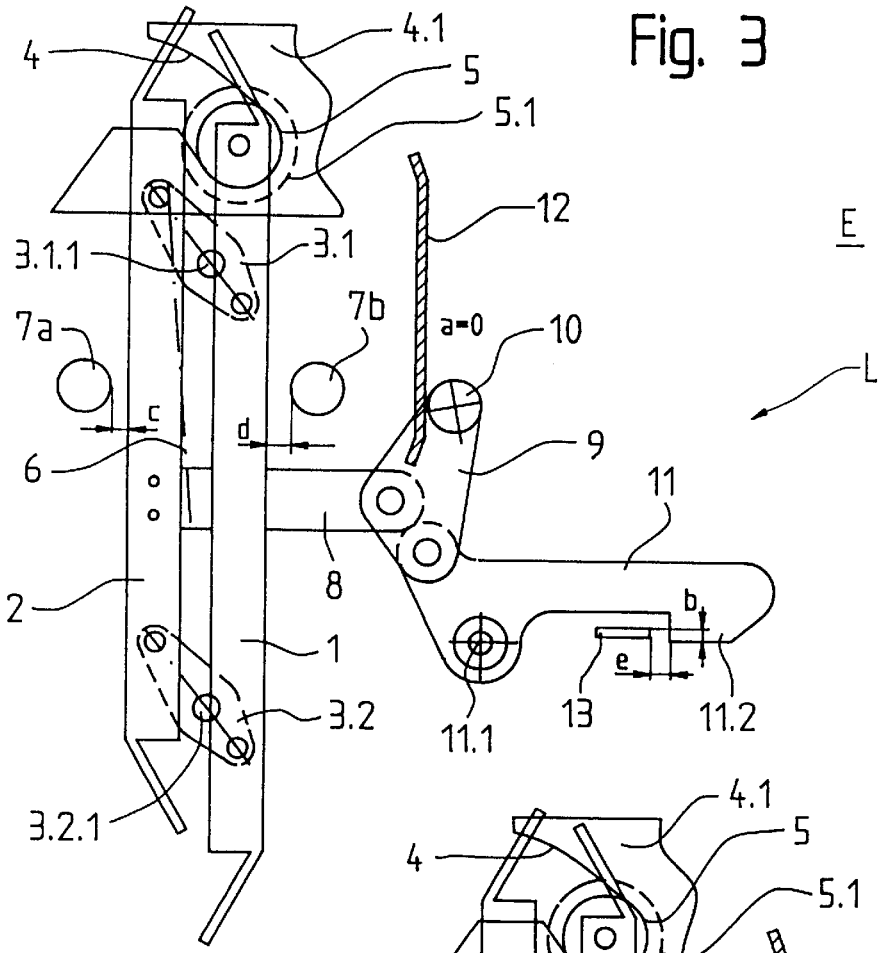
FIGS. 3 and 4 show the apparatus of the FIG. 1 with the entraining system and locking mechanism positions at the beginning of the opening process.

The position of the entraining system E and the locking mechanism L at the beginning of the opening process is illustrated in the FIG. 3. With the signal "door open" of a door control, which is not illustrated, the opening of the car door begins without delay, wherein the shaft door is still disposed in the rest state. A time delay due to the previous spreading of the entrainers does not arise. The entrainers 1, 2, the transmission lever 8, the locking rocker 9 with the support roller 10 and the catch 11 move with the car door and execute a relative movement relative to the shaft lock rollers 7*a*, 7*b*, the support rail 12 and the lock plate 13. The spacings "a", "c", "d" and "e" are reduced. The reduction in the spacing "a", in particular, is of significance in order to quickly open the catch 11, wherein the transmission lever 8 executes a movement which is composed of the superimposition of the car door movement and of the movement of the second entraining cam 2. The transmitted lock movement is transmitted by means of the locking rocker 9 to the support roller 10, which rapidly approaches the support rail 12. In the present example, the car door moves in the opening direction from right to left. The lever axles 3.1.1, 3.2.1 arranged at the car door also move with the car door. The spreading of the entrainers 1, 2 takes place constrainedly by means of the rollers 5 guided along the entry cam 4 of the stationary travel rail 4.1. The spreading of the entrainers 1, 2 begins as soon as the car door begins to move. The second entraining cam 2 moves to the left and downwardly. This movement is similarly executed by the transmission lever 8, which effects a pivot movement of the locking rocker 9 about the axle at the catch 11. After about three millimeters of travel of the car door, the aforesaid spacing "a", which is designated as through-travel play, of about ten millimeters is overcome in consequence of the superimposition of the car door movement and the entrainer movement, and the support roller 10 bears against the support rail 12.

Figure 4:
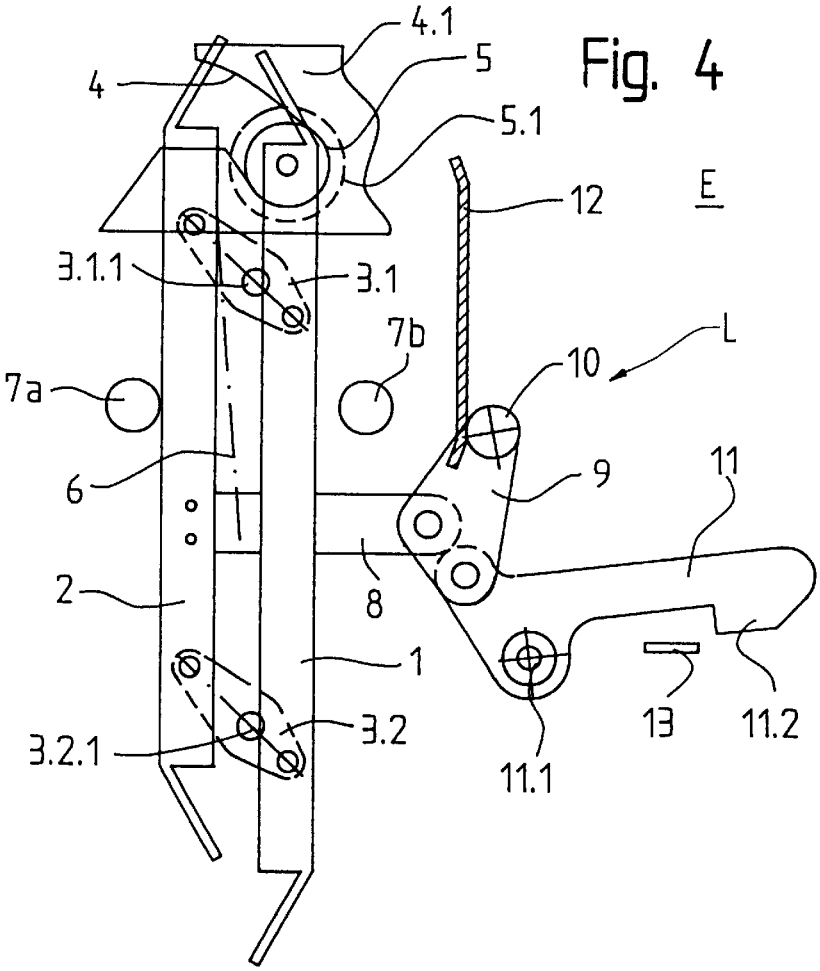

The position of the entraining system E and the locking mechanism L after the beginning of the opening process is illustrated in the FIG. 4. Due to the progressing opening of the car door, the locking rocker 9 is obliged to continue its pivot movement. As the roller 10 is supported at the support rail 12, a further pivot movement of the locking rocker 9 is not possible and a tipping of the locking rocker about the axle at the transmission lever 8 comes about. In that case the support roller 10 slides downwardly along the support rail 12 and causes opening of the catch 11.

Figure 5:
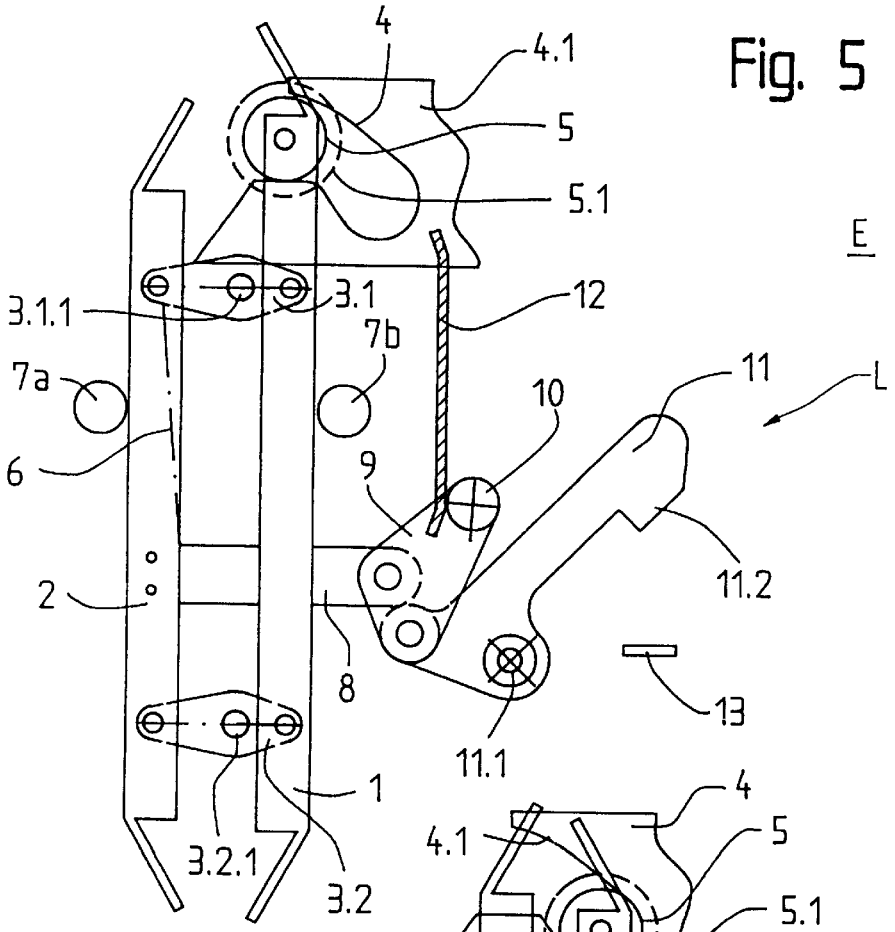
FIG. 5 shows the apparatus of the FIG. 1 with the entraining system and locking mechanism in the end position during the opening process.

The end position of the entraining system E and the locking mechanism L in the opening process is shown in the FIG. 5. The doors are driven and held open in this end position. The roller 5 has reached the highest point of the entry cam 4 and has fully spread the entrainers 1, 2. The entrainers 1, 2 bear against the shaft lock rollers 7*a*, 7*b*, whereby the car door is coupled with the shaft door. The catch is fully opened.

Figure 6:
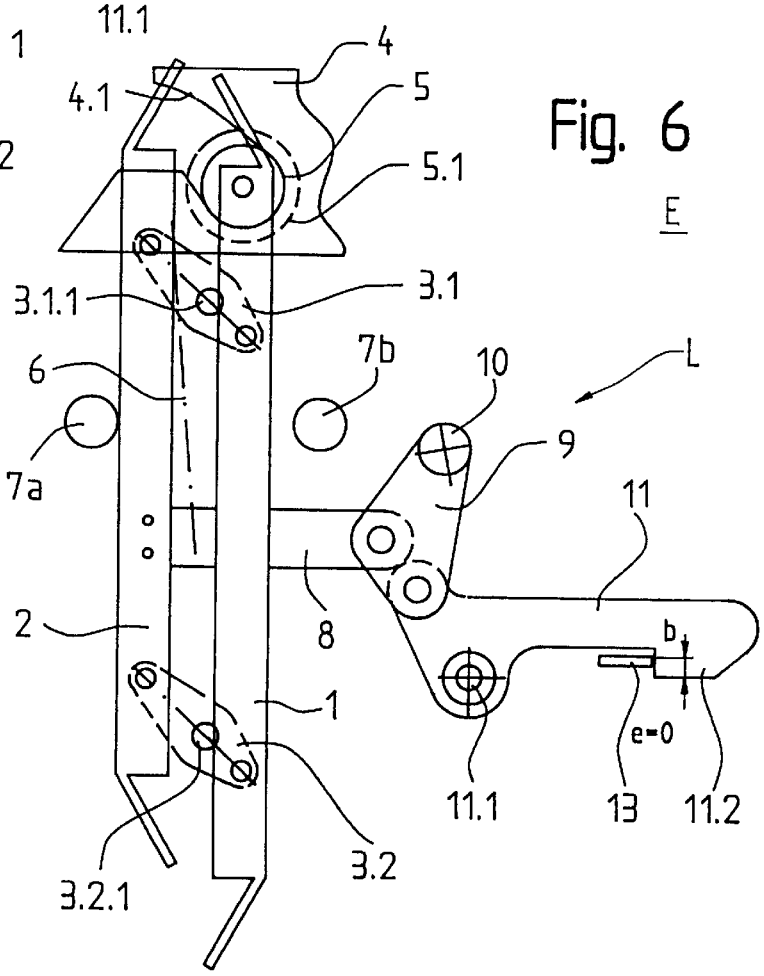
FIG. 6 shows the apparatus of the FIG. 1 with the entraining system and locking mechanism in a locking position outside an unlocking zone.

The position of the entraining system E and the locking mechanism L outside an unlocking zone is illustrated in the FIG. 6. No support rails 12 are present between the floors or outside the unlocking zone. Without the support rails 12, the pivot movement of the locking rocker 9 can be continued unhindered. The car door can move only so far until the spacing "e" is zero and the lug 11.2 of the catch 11 stands in line with the locking plate 13. A further movement of the car door is blocked by the catch 11 and the car door cannot open.

In the closing process, the movements shown in the FIGS. 2 to 5 elapse in reverse sequence. The illustrated entraining system E and the illustrated locking mechanism L are constructed for doors opening to the left as seen from the floor. For doors opening to the right, the entraining system and the locking mechanism are executed in mirror image.

In summary, the apparatus for opening and closing a car door and a shaft door of a elevator installation during a stop of an elevator car at a floor comprises: the entraining system E coupling the elevator car door to an adjacent shaft door, the entraining system including the first and second entraining cams 1, 2 connected by the pair of levers 3.1, 3.2 forming a spreadable parallelogram; and the locking mechanism L including the transmission lever 8 attached to the second entraining cam 2, the locking rocker 9 pivotally attached to the transmission lever, the support roller 10 mounted on the locking rocker, the catch 11 pivotally attached to the locking rocker, the support rail 12 attached to the shaft door and the lock plate 13 attached to the car, whereby when the car door is closed the catch 11 engages the lock plate 13 to lock the car door and as the car door is opened, the support roller 10 contacts the support rail 12 rotating the catch 11 out of engagement with the lock plate 13 and unlocking the car door.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for opening and closing a car door and a shaft door of a elevator installation during a stop of an elevator car at a floor comprising:

an entraining system for coupling a car door of an elevator car to a shaft door to effect coordinated opening and closing of the doors; and a locking mechanism including a transmission lever having one end attached to said entraining system and an opposite end, a locking rocker pivotally attached to said opposite end of said transmission lever, a support roller mounted on said locking rocker, a support rail adapted to be mounted on the shaft door for contact with said support roller, a catch adapted to be pivotally mounted on the car door and being pivotally attached to said locking rocker, and a lock plate adapted to be mounted to the elevator car a predetermined spacing from said catch for engagement with said catch;

whereby when said entraining system and said locking mechanism are mounted on the elevator car and the shaft door, the car is outside an unlocking zone and the car door begins to open, said catch engages said lock plate to prevent opening of the car door in excess of the predetermined spacing between said catch and said lock plate; and whereby when the car is in the unlocking zone and the car door begins to open, said support roller is moved into contact with said support rail through a combination of movement of the car door and actuation of said entraining system to rotate said catch out of engagement with said lock plate and unlock the car door thereby reducing a time required to open the car door and an adjacent shaft door.

2. The apparatus according to claim 1 wherein said entraining system includes a pair of spreadable entraining cams and said one end of said transmission lever is attached to one of said entraining cams.

3. The apparatus according to claim 2 wherein said transmission lever executes a movement composed of a superimposition of the car door movement and of a movement of said one entraining cam to rotate said catch out of engagement with said lock plate.

4. The apparatus according to claim 1 wherein said catch has a lug formed thereon which detents with said lock plate.

5. The apparatus according to claim 1 wherein said support rail extends generally vertically across a path of horizontal movement of said support roller.

6. An apparatus for opening and closing a car door and a shaft door of a elevator installation during a stop of an elevator car at a floor comprising:

an entraining system for coupling a car door of an elevator car to a shaft door, said entraining system including first and second entraining cams connected by a pair of levers forming a spreadable parallelogram; and a locking mechanism including a transmission lever having one end attached to said second entraining cam and an opposite end, a locking rocker pivotally attached to said opposite end of said transmission lever, a support roller mounted on said locking rocker, a support rail adapted to be mounted on the shaft door for contact with said support roller, a catch adapted to be pivotally mounted on the car door and being pivotally attached to said locking rocker, and a lock plate adapted to be mounted to the elevator car a predetermined spacing from said catch for engagement with said catch;

whereby when said entraining system and said locking mechanism are mounted on the elevator car and the shaft door, the car is outside an unlocking zone and the car door begins to open, said catch engages said lock plate to prevent opening of the car door in excess of the predetermined spacing between said catch and said lock plate; and whereby when the car is in the unlocking zone and the car door begins to open, said support roller is moved into contact with said support rail through a combination of movement of the car door and spreading of said entraining cams to rotate said catch out of engagement with said lock plate and unlock the car door thereby reducing a time required to open the car door and an adjacent shaft door.

7. The apparatus according to claim 6 wherein said entraining system includes a roller attached to said first entraining cam and engaging an entry cam on the car for spreading said entraining cams apart upon an opening movement of the car door.

* * * * *